United States Patent [19]

Romberg et al.

[11] 4,453,577

[45] Jun. 12, 1984

[54] NOZZLE WITH AUTOMATIC SWITCH-OFF

[75] Inventors: Helmut Romberg, Bad Durkheim; Horst Koerner, Boehl-Iggelheim, both of Fed. Rep. of Germany

[73] Assignee: BASF Aktiengesellschaft, Ludwigshafen, Fed. Rep. of Germany

[21] Appl. No.: 371,013

[22] Filed: Apr. 22, 1982

[30] Foreign Application Priority Data

May 5, 1981 [DE] Fed. Rep. of Germany ..... 3117669

[51] Int. Cl.[3] ..... B67D 5/04

[52] U.S. Cl. ..... 141/209

[58] Field of Search ..... 141/1, 198, 206, 207, 141/208, 209, 210, 392; 137/390

[56] References Cited

U.S. PATENT DOCUMENTS

| | | | |
|---|---|---|---|
| 3,075,563 | 1/1963 | Botkin | 141/209 |
| 3,101,101 | 8/1963 | Gearhart et al. | 141/207 |
| 3,196,908 | 7/1965 | Billian | 141/209 |
| 3,380,491 | 4/1968 | Rosell et al. | 141/209 |
| 3,877,498 | 4/1975 | Lancellin | 141/198 X |
| 4,343,336 | 8/1982 | Trygg | 141/206 X |

FOREIGN PATENT DOCUMENTS

| | | | |
|---|---|---|---|
| 2641049 | 9/1976 | Fed. Rep. of Germany | 141/207 |
| 972206 | 10/1964 | United Kingdom | 141/209 |
| 1562494 | 3/1980 | United Kingdom . | |

*Primary Examiner*—Stephen Marcus
*Assistant Examiner*—Mark Thronson
*Attorney, Agent, or Firm*—Keil & Witherspoon

[57] ABSTRACT

A nozzle for filling containers with liquid, with automatic closing of the nozzle, when they are full, by means of a flow valve which is controllable by a delivery lever via a detachable connection. The connection is acted upon by a switching device which, according to the pressure in a pressure channel terminating at the outlet orifice of the nozzle, causes the valve to close.

4 Claims, 2 Drawing Figures

NOZZLE WITH AUTOMATIC SWITCH-OFF

Figure 1:
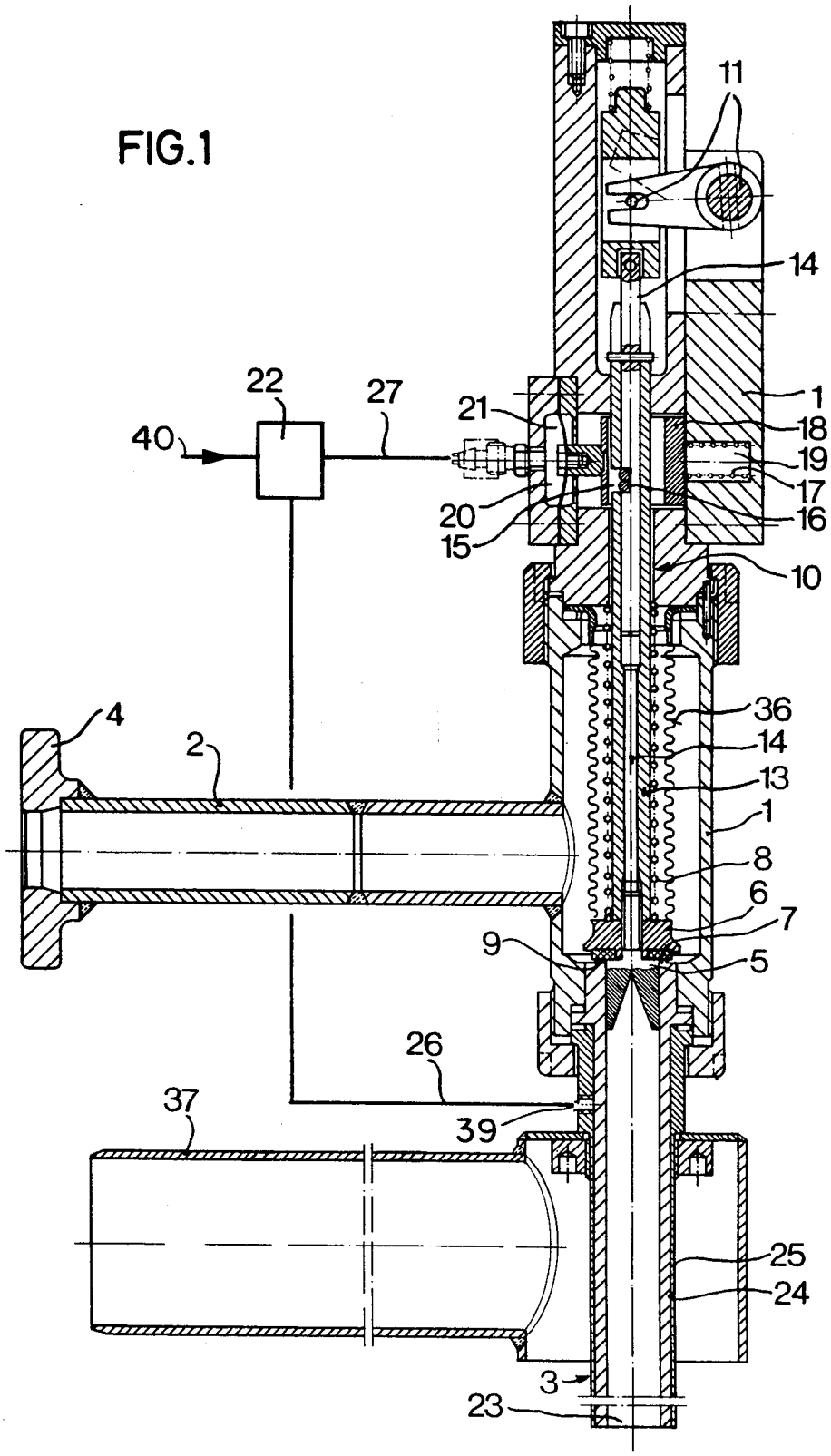

The invention relates to a nozzle for filling containers with liquid, with automatic termination of delivery when they have been filled, comprising a nozzle body which is equipped with an inlet tube and an outlet tube, a valve, which is located in the nozzle body and can be operated by means of a delivery lever, for controlling the flow of liquid from the inlet to the outlet, and a switching device which is connected via a pressure channel to the orifice of the outlet tube and closes the valve according to the pressure prevailing in the pressure channel.

A filling apparatus of this type is described in German Laid-Open Application DOS No. 2,641,049. It consists essentially of a hand-operated flow valve and a suction-controlled closing device by means of which the valve is closed automatically when the vessel or tank has been filled. The closing device has a membrane which closes off a pressure chamber and which, on the chamber side, is exposed via a pressure channel to the suction generated in the valve by the flow of liquid, while on the other side it is coupled to an element which detachably, under spring tension, connects the delivery lever and the valve. From the pressure chamber, a further pressure channel leads to a point adjacent to the orifice of the filling tube. Consequently, the suction acting on the membrane only becomes effective when the liquid level in the container seals the orifice and hence the pressure channel. The suction force which acts on the membrane overcomes the spring tension, so that the connecting element is released from the locking position. The valve body, which is also under spring pressure, then passes into the closed position.

An apparatus of this type only operates satisfactorily if the flow rate in the valve, required to generate sufficient suction, is relatively high. For conventional nozzles of gasoline pumps, a gasoline pressure of about 4 bar is provided for this purpose. For dispensing explosive or highly flammable liquids, such as solvents, in factories, high flow rates are impermissible, because of the static charge which they cause. The air sucked into the liquid via the pressure channel also constitutes a safety hazard. Moreover, it entails increased solvent vapor emission, which pollutes the environment and is a nuisance to the operatives.

It is an object of the present invention to provide an automatically closing nozzle in which the pressure medium for controlling the switching device which serves to close the valve does not come into contact with the liquid to be dispensed, and control is independent of the flow rate of the liquid.

We have found that this object is achieved if, in a nozzle of the type described at the outset, the pressure-dependent switching device consists of a switching member which responds to a particular pressure in the pressure channel and of a drive member controlled by the switching member, the drive member being coupled to a connecting element detachably inserted between the delivery lever and the valve.

In an advantageous embodiment of the nozzle according to the invention, the pressure-dependent switching member is a pneumatic relay, whose outlet for the working pressure is connected to a pneumatic drive member.

In a further advantageous embodiment, the pressure-dependent switching member is an electro-pneumatic pressure switch, and the drive member switched thereby is an electromagnet, whose armature is coupled to the detachable connecting element.

Further details and advantages of the invention will be clear from the Examples described below with reference to the drawing.

Figure 2:
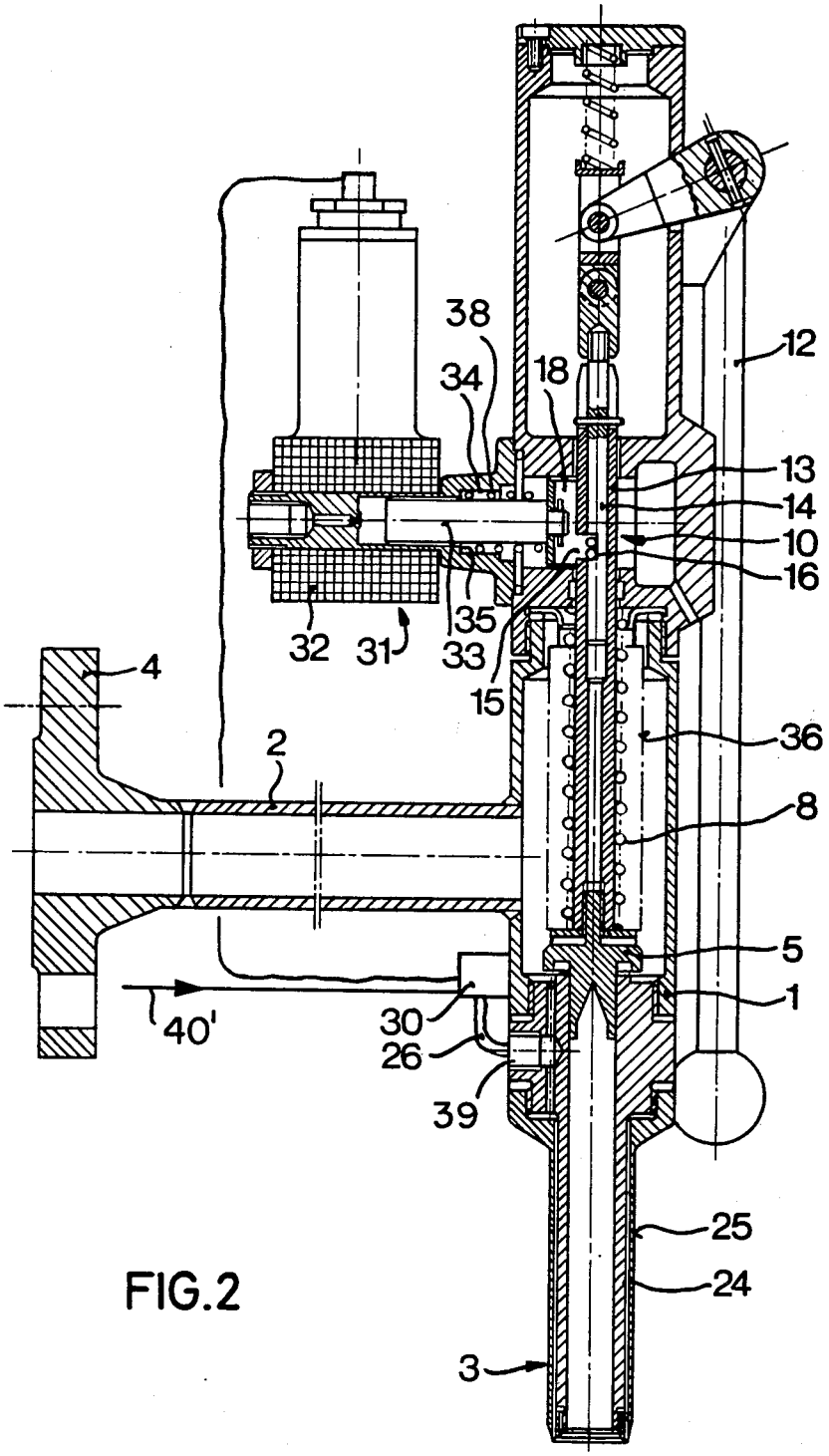

In the drawing,

FIG. 1 shows a longitudinal section of the nozzle with a pneumatic switching device, and FIG. 2 shows a longitudinal section of the nozzle with an electrical switching device.

FIGS. 1 and 2 show a nozzle whose construction in respect of the manually operable flow control is known in principle and is described, for example, in German Laid-Open Application DOS No. 2,641,049. It comprises a nozzle body 1 with an inlet tube 2 and an outlet tube 3. The inlet is fitted with conventional devices 4 for connection to a feedline, especially a hose. The stream of liquid from the inlet tube to the outlet tube is controlled by a valve 5, the gasket 7 of whose valve body 6 is pressed against the valve seat 9 by means of a pressure spring 8. For operation of the valve, the valve body is connected to a delivery lever 12 via a rod system 10 and pivots 11. The rod system consists of a guide tube 13 attached to the valve body and of a connecting rod 14 which is connected via the pivots to the delivery lever and can slide in the guide tube. The guide tube and connecting rod are provided with holes 15 which match up and run transversely to the lengthwise axis, and into these holes two pins 16, serving as the connecting element, are pressed, by means of a drive member, against a pressure spring 17, so that the movements of the delivery lever are transmitted to the valve body. The pins are fastened in a holder 18 which can also slide transversely to the lengthwise axis and is braced against the pressure spring 17 resting in a recess 19 of the nozzle body 1. The holder consists of a U-shaped member with holes in the U-legs for receiving the pins, the back of the member being connected to a membrane 21 which closes off a pressure chamber 20, which chamber and membrane together form the drive member for the sliding motions.

According to the invention, a connection is provided, via a pressure line 27, between the pressure chamber and a pneumatic relay 22 which serves as the switching member and whose inlet is connected to a pressure channel 24 which extends up to the orifice 23 of the outlet tube 3. A further tube 25, attached to the nozzle body 1, is located concentrically around the outlet tube and at a very short distance (about 0.1 mm, therefrom), so that the annular space of the double-walled tube thus produced forms the pressure channel 24. A capillary hose 26, connected to the tube 25 via a hole, is advantageously used as the connection between the relay and the pressure channel, which is open at the orifice end and is sealed against the nozzle body.

While the nozzle is delivering, the membrane 21 is subjected to compressed air by the relay 22 via the pressure line, so that the pins 16 are held, against the spring 17, in the holes 15 of the rod system 10. When the liquid level in the container to be filled rises above the orifice 23 of the outlet tube 3, the air in the pressure channel 24 is slightly compressed by the liquid. As a result of the very small volume of the annular space forming the pressure channel and of the capillary hose, this is accompanied by a rise in pressure which suffices to switch over the pneumatic relay 22. To accentuate this pressure rise, the annular gap is flared at the orifice 23. After switch-over, the membrane 21 is no longer under pressure, so that the pressure spring 17 engaging on the holder 18 is able to push the pins 16 out of the holes 15. This breaks the connection between the guide tube 13 and the connecting rod 14. The spring 8, engaging on the valve body 6, can then press the latter onto the valve seat 9, after which the valve is in the closed position.

If the orifice 23 of the outlet tube 3 becomes free again, the relay 22 switches back, because of the pressure drop. Thereafter, the membrane is again under pressure, so that the pins 16 are pressed against the rod system 10 and, after the connecting rod 14 has been pushed back into the closed position by the delivery lever 12, can again engage in the holes 15. The valve can then be operated again.

FIG. 2 shows a further embodiment of the nozzle according to the invention, in which the pressure-dependent switching device of the nozzle—which in other respects is the same as in FIG. 1—consists of a commercial electro-pneumatic pressure switch 30 and an electromagnet 31 controlled thereby. The control input of the pressure switch, which is attached to the nozzle body 1, is also connected to the pressure channel 24 via a capillary hose 26. Its electrical output is connected to the coil 32 of the electromagnet, whose axially movable armature 33 is coupled to the U-shaped holder 18 for the pins 16. The pressure spring 38 in this case acts on the holder 18, in accordance with its location in a cylindrical hole 34 in the nozzle body 1, in the direction of engagement of the pins into the holes 15, and for this purpose rests on the one hand against the shoulder 35 of the hole 34 and on the other hand against the back of the U-shaped holder.

When the pressure in the pressure channel 24 increases, as a result of the liquid level in the container being filled rising above the channel, the pressure switch 30 is actuated and this connects the coil 32 of the electromagnet 31 to the current supply. The force of the magnetic field of the live coil draws the armature 33 into the coil and accordingly moves the holder 18, with the pins 16, away from the rod system 10. This breaks the connection between the guide tube 13 and the connecting rod 14, so that the valve 5 is brought into the closed position by means of the spring 8. When the outlet tube orifice becomes free, the electromagnet 31 is switched off again because of the pressure drop in the pressure channel, and the valve can be operated again, as described above.

The use of an electromagnet as the drive member has the advantage that high driving forces can be generated, so that even relatively high friction of the valve mechanics—for example resulting from strong valve springs being used to give high sealing forces—can be overcome.

In a further development, not shown in the drawing, of the nozzle described above, the pressure channel 24 is connected via side nipple 39 and connecting line 26 to gas pressure source 40, FIG. 1, or 40', FIG. 2, for example air or nitrogen. The gas, which continuously issues, in very small amount, from the orifice 23 of the outlet tube 3 keeps the annular gap free from any deposits, for example crystallization products, and from residual amounts of the liquid being delivered. If then the orifice dips into the said liquid, the resistance to flow at the annular gap, and accordingly the pressure in the pressure channel, increase. The pneumatic relay 22 or electropneumatic pressure switch 30, which are advantageously directly connected to the pressure system, for example by means of a bypass, respond to the pressure increase and cause the valve to close, as described above. When the annular gap is again out of the liquid, the back pressure in the channel 24 drops, so that the switching device (22, 21; 30, 31) brings the valve back into the state in which it can be operated.

With respect to the liquid flowing via the inlet tube into the nozzle body 1, it has proved advantageous to seal the passage of the guide tube 13 through the housing by means of bellows 36, fixed on the one hand around the passage and on the other hand onto the valve body 6. If the valve is to close reliably, a stuffing box is not a suitable sealing element, because of the high friction against the tube.

The waste air channel 37, shown in FIG. 1, serves to draw off the solvent vapors released during filling.

We claim:

1. A nozzle for filling containers with liquid, with automatic termination of delivery when they have been filled, comprising a nozzle body which is equipped with an inlet tube and an outlet tube, said outlet tube including an orifice, a valve which is located in the nozzle body, said valve controlling the flow of liquid from the inlet tube to the outlet tube, a delivery lever for operating said valve, a connecting element detachably inserted between the delivery lever and the valve, a pneumatic drive member coupled to said connecting element and a pneumatic relay, the input of said pneumatic relay being connected via a pressure channel to the orifice of the outlet tube and the output of said relay being connected to said pneumatic drive member, said relay responding to a particular pressure in said pressure channel to control said drive member so as to close said valve.

2. A nozzle for filling containers with liquid, with automatic termination of delivery when they have been filled, comprising a nozzle body which is equipped with an inlet tube and an outlet tube, said outlet tube including an orifice, a valve which is located in the nozzle body, said valve controlling the flow of liquid from the inlet tube to the outlet tube, a delivery lever for operating said valve, a connecting element detachably inserted between the delivery lever and the valve, an electromagnet having an armature coupled to said connecting element and an electropneumatic pressure switch, the input of said electropneumatic pressure switch being connected via a pressure channel to the orifice of the outlet tube and the output of said pressure switch being connected to said electromagnet, said pressure switch responding to a particular pressure in said pressure channel to control said electromagnet so as to close said valve.

3. A nozzle as claimed in claim 1 or 2, wherein the outlet tube is constructed as a double-walled tube, with an annular space between the two walls, said annular space serving as said pressure channel and being connected to said input.

4. A nozzle as claimed in claim 1 or 2, wherein said pressure channel is connected to a source of gas pressure.

* * * * *